US010519593B2

(12) United States Patent
Turrin et al.

(10) Patent No.: US 10,519,593 B2
(45) Date of Patent: Dec. 31, 2019

(54) IRONING APPARATUS

(71) Applicant: ELECTROLUX PROFESSIONAL S.P.A., Pordenone (IT)

(72) Inventors: Daniele Turrin, Pordenone (IT); André Maziere, Senlis (FR); Paolo Cescot, Pordenone (IT)

(73) Assignee: Electrolux Professional S.p.A., Pordenone (IT)

( * ) Notice: Subject to any disclaimer, the term of this patent is extended or adjusted under 35 U.S.C. 154(b) by 166 days.

(21) Appl. No.: 15/744,927

(22) PCT Filed: Jul. 21, 2016

(86) PCT No.: PCT/EP2016/067378

§ 371 (c)(1),
(2) Date: Jan. 15, 2018

(87) PCT Pub. No.: WO2017/016968

PCT Pub. Date: Feb. 2, 2017

(65) Prior Publication Data

US 2018/0202098 A1 Jul. 19, 2018

(30) Foreign Application Priority Data

Jul. 24, 2015 (EP) ..... 15178280

(51) Int. Cl.
*D06F 67/02* (2006.01)
*D06F 69/02* (2006.01)
(Continued)

(52) U.S. Cl.
CPC ..... *D06F 67/02* (2013.01); *D06F 69/02* (2013.01); *F23D 14/14* (2013.01); *F23D 91/02* (2015.07);
(Continued)

(58) Field of Classification Search
CPC ..... D06F 67/02; D06F 69/00; D06F 69/02; D06F 2202/04; D06F 2202/10;
(Continued)

(56) References Cited

U.S. PATENT DOCUMENTS 1,427,625 A * 8/1922 Nicholson ..... E04B 5/44 52/324
3,452,967 A * 7/1969 Durand ..... D06B 23/028 432/228
(Continued)

FOREIGN PATENT DOCUMENTS

EP 289805 A * 11/1988
EP 0682137 11/1995
EP 1707664 10/2006

OTHER PUBLICATIONS

International Search Report for PCT/EP2016/067348, dated Sep. 26, 2016, 2 pages.

*Primary Examiner* — Ismael Izaguirre
(74) *Attorney, Agent, or Firm* — Pearne & Gordon LLP

(57) ABSTRACT

An ironing apparatus (100) comprises a rotating cylinder (11) and a burner assembly (2) comprising a main body (20) in which a passage (21) for a mixture of air and gas is defined. The main body comprises an outlet surface (22) in which a plurality of holes (220) are defined, through which the mixture of air and gas exits from the passage, wherein the passage is elongate-shaped, extends in a longitudinal direction inside said rotating cylinder and has a decreasing cross section along the longitudinal direction (x).

16 Claims, 12 Drawing Sheets

(51) Int. Cl.
*F23D 14/14* (2006.01)
*F23D 99/00* (2010.01)

(52) U.S. Cl.
CPC ..... *D06F 2202/04* (2013.01); *D06F 2202/10* (2013.01); *D06F 2204/02* (2013.01); *D06F 2204/04* (2013.01); *D06F 2204/065* (2013.01)

(58) Field of Classification Search
CPC ..... D06F 2202/12; D06F 2204/02; D06F 2204/04; D06F 2204/065; D06F 2204/10; F23D 14/14; F23D 14/145; F23D 14/22; F23D 91/02; F23D 91/04; F26B 3/22; F26B 3/24
See application file for complete search history.

(56) References Cited

U.S. PATENT DOCUMENTS 3,939,763 A * 2/1976 Sato ..... B30B 9/121 100/340
4,282,639 A * 8/1981 Christ ..... D21G 1/022 100/162 B
5,553,391 A * 9/1996 Bakalar ..... D21F 5/002 34/110

* cited by examiner

IRONING APPARATUS

FIELD OF THE INVENTION

The present invention relates to an ironing apparatus of the type comprising a rotating cylinder and a burner located in the interior of the rotating cylinder.

BACKGROUND OF THE INVENTION

Industrial cylinder ironers, also known as mangle ironers, are well known in the art.

These ironing apparatuses typically comprise a rotating cylinder and a group of endless belt members. Linen or laundry to be ironed is introduced between the rotating cylinder and the belt. A gas, steam or electrical heating source, e.g. a burner, is placed within the cylinder in order to contribute to the drying and ironing of the linen or laundry. Once dried and ironed, linen or laundry is collected in loose form in a reception tub or folded by an appropriate device.

An example of such apparatus is disclosed in EP 0 682 137, related to an ironing machine having a rotating cylinder of a pipe burner, which comprises a dense network of microperforations.

Microflames mainly form in the microperforations and ensure a heating mainly in the infrared range. It is thus possible to orient the microflames towards that part of the cylinder which is in contact with the linen or laundry.

Known art mangle-type ironers can be nevertheless improved in terms of efficiency of the radiant effect provided by the burner.

SUMMARY OF THE INVENTION

An object of the invention is to provide an ironing apparatus comprising a rotating cylinder and a burner assembly which has an improved efficiency of the radiant effect provided by the burner.

A further object is to provide an ironing apparatus in which ironing operation can be effectively controlled.

Another object of the invention is to provide an ironing apparatus capable of maintaining a constant distribution of temperature during ironing operation.

Still another object of the invention is to provide an ironing apparatus capable of reacting quicker to changes of working parameters, such as temperature or moist.

Another object of the invention is to provide an ironing apparatus comprising a burner assembly having a reduced duty cycle.

Also object of the invention is to provide an ironing apparatus with optimized gas consumption.

Furthermore, it is also an object of the present invention to provide an ironing apparatus having a robust mechanical design.

In addition, an object of the present invention is also to provide an ironing apparatus in which the burner assembly can be set easily.

According to the invention it is provided an ironing apparatus comprising:

a rotating cylinder;

a burner assembly comprising a main body in which a passage for a mixture of air and gas is defined, said main body comprising an outlet surface in which a plurality of holes are defined, through which the mixture of air and gas exits from said passage, wherein said passage is elongate-shaped and extends in a longitudinal direction inside said rotating cylinder;

wherein said passage has a decreasing cross section along said longitudinal direction.

It is clear that "decreasing" has to be understood as decreasing in a direction starting from the extremity of the passage for the mixture of air and gas in which this mixture enters the passage, to the opposite end thereof in the longitudinal direction of the passage.

Advantageously the main body is elongate-shaped too, so that it has a longitudinal axis, which advantageously coincides with the longitudinal axis of the passage for the mixture of air and gas.

It is to be understood that in the ironing apparatus according to the invention, the decreasing cross section allows a lower propagation time of the flame front along the main body.

Also, the volume of the main body can be reduced in comparison to a solution in which the passage has constant cross section. In this manner the burner assembly has a lower inertia and it is possible to provide the burner assembly with quicker reaction time.

This also means a reduction in the duty cycle and the possibility of using a simpler control system for the burner assembly since the control system can operate in a proportional way for controlling the burner assembly.

Accordingly, the gas consumption can be optimized, since temperature can be maintained more constant due to the shorter duty cycle.

According to another aspect of the invention, the longitudinal direction is substantially parallel to a rotation axis of the rotating cylinder. In this manner, the inner volume of the cylinder can be effectively exploited and it is possible to create an appropriate temperature profile on the outer surface of the cylinder.

Preferably, the main body comprises a premixing zone intermediate between the passage and the outlet surface, the premixing zone being separated by the passage by a perforated surface. According to a preferred aspect, the perforated surface is parallel to the outlet surface.

Both these features allow obtaining a more uniform flame front on the outlet surface of the main body.

According to a preferred embodiment, the holes defined in the perforated surface are bigger than the holes defined in the outlet surface.

In this manner the pressure drop is split in two steps, and the holes in the outlet surface still provide a suitable pressure drop in order to have a proper control of the flame.

According to a preferred embodiment, the burner assembly comprises an air introduction device, the cross section of the passage gradually decreasing from a first end of the main body connected to the air introduction device towards an opposite end thereof.

In this manner it is possible to optimize and make more uniform the flow of the mixture of gas and air inside the passage.

Preferably, the burner assembly comprises a filter element comprising a cyclone separator, the cyclone separator being located upstream the air introduction device.

In this manner it is possible obtaining a strong reduction in clogging problems of the filter element.

According to a preferred embodiment, the density and the dimension of holes of the outlet surface is constant along the longitudinal direction.

This also contributes to make the front flame more uniform, notwithstanding the reduction of the cross section of the passage.

According to a further aspect of the invention, the burner assembly comprises at least one turbulator provided upstream or at the beginning of the passage.

This feature is helpful in improving the mixing of air and gas in the main body.

Preferably at least one turbulator comprises a perforated surface having (preferably hexagonal shaped) holes.

According to a preferred embodiment, the outlet surface is at least partially curved, thus allowing an increasing of the radiant component of the heat exchanged and a consequent reduction in the temperature of the exhaust gases.

Furthermore, according to a preferred embodiment, the burner assembly further comprises a metal mesh covering said outlet surface, in order to protect the holes from which the mixture of air and gas passes from dust or other particles. The flames produced in the outlet surface and the related hot fumes heats up the metal mesh, which becomes incandescent and starts irradiating heat towards the rotating cylinder, which is therefore heated up.

According to another aspect, the invention also relates to a control method for an ironing apparatus comprising a rotating cylinder, a burner assembly comprising a main body in which a passage for a mixture of air and gas is defined, the main body comprising an outlet surface in which a plurality of holes are defined, through which the mixture of air and gas exits from said passage, wherein the passage is elongate-shaped and extends in a longitudinal direction inside the rotating cylinder, comprising:

- measuring temperature on an outer diameter of the rotating cylinder;
- measuring a moisture level of an item subjected to ironing;
- determining the type of fabric of the item subjected to ironing;
- adjusting the flow-rate of the mixture of air and gas according to temperature and moisture level measured and according to the type of fabric determined.

It is to be understood that also in the control method of an ironing apparatus according to this aspect of the invention, the adjustment of the flow-rate of the mixture according to the values measured and determined allows a reduction in the duty cycle and to use a simpler control system for the burner assembly.

Therefore, also according to this aspect it is possible to optimize the gas consumption, since the ironing operations, which are related to the flow-rate of the mixture of air and gas, can be quicker and more precisely controlled.

Preferably the control method also comprises adjusting the rotation speed of the rotating cylinder according to temperature and moisture level measured and according to the type of fabric determined. In this manner the control of the ironing operation can be further improved.

According to a preferred embodiment, the burner assembly comprises an air introduction device including a blower, and adjusting the flow-rate of the mixture of air and gas comprises adjusting the speed of the blower. This feature allows controlling the flow-rate easily and at the same time in a precise manner.

According to a further aspect, the ironing apparatus comprises a control panel, and determining the type of fabric of the item subjected to ironing comprises selecting the type of fabric on the control panel.

Accordingly, the type of fabric can be determined and the relevant information used for controlling the ironing operations without requiring sensor means that can be complex and not enough reliable.

BRIEF DESCRIPTION OF THE DRAWINGS

These and other features and advantages of the invention will be better apparent from the following description of some exemplary and non-limitative embodiments, to be read with reference to the attached drawings, wherein.

DETAILED DESCRIPTION OF THE INVENTION

With reference to attached Figures, an ironing apparatus according to the invention is generally designated with the reference number 100.

Figure 2:
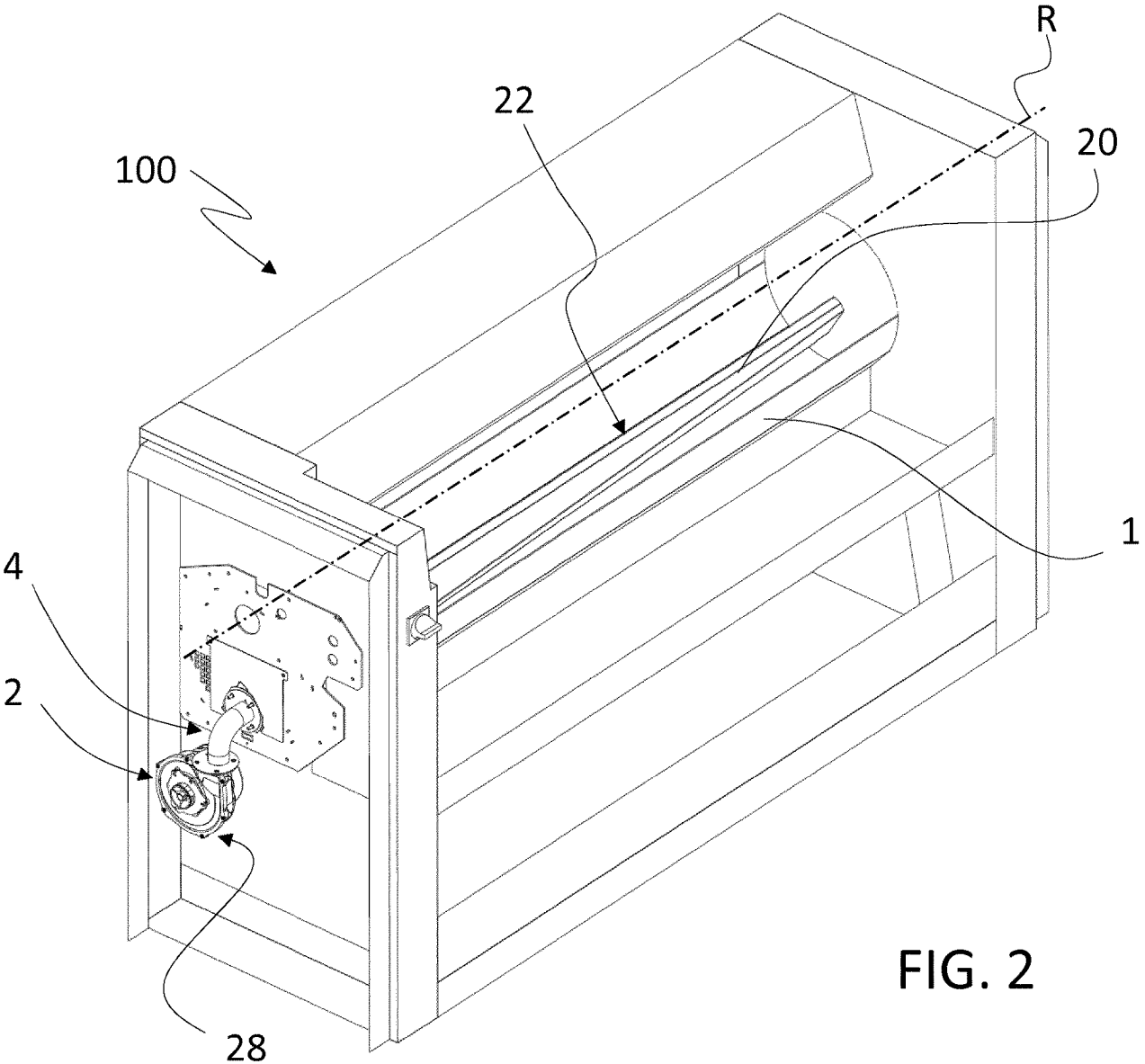
FIG. 2 is a perspective view of the ironing apparatus of FIG. 1A in which some components have been removed in order to make visible a rotating cylinder and a burner assembly.
Figure 3:
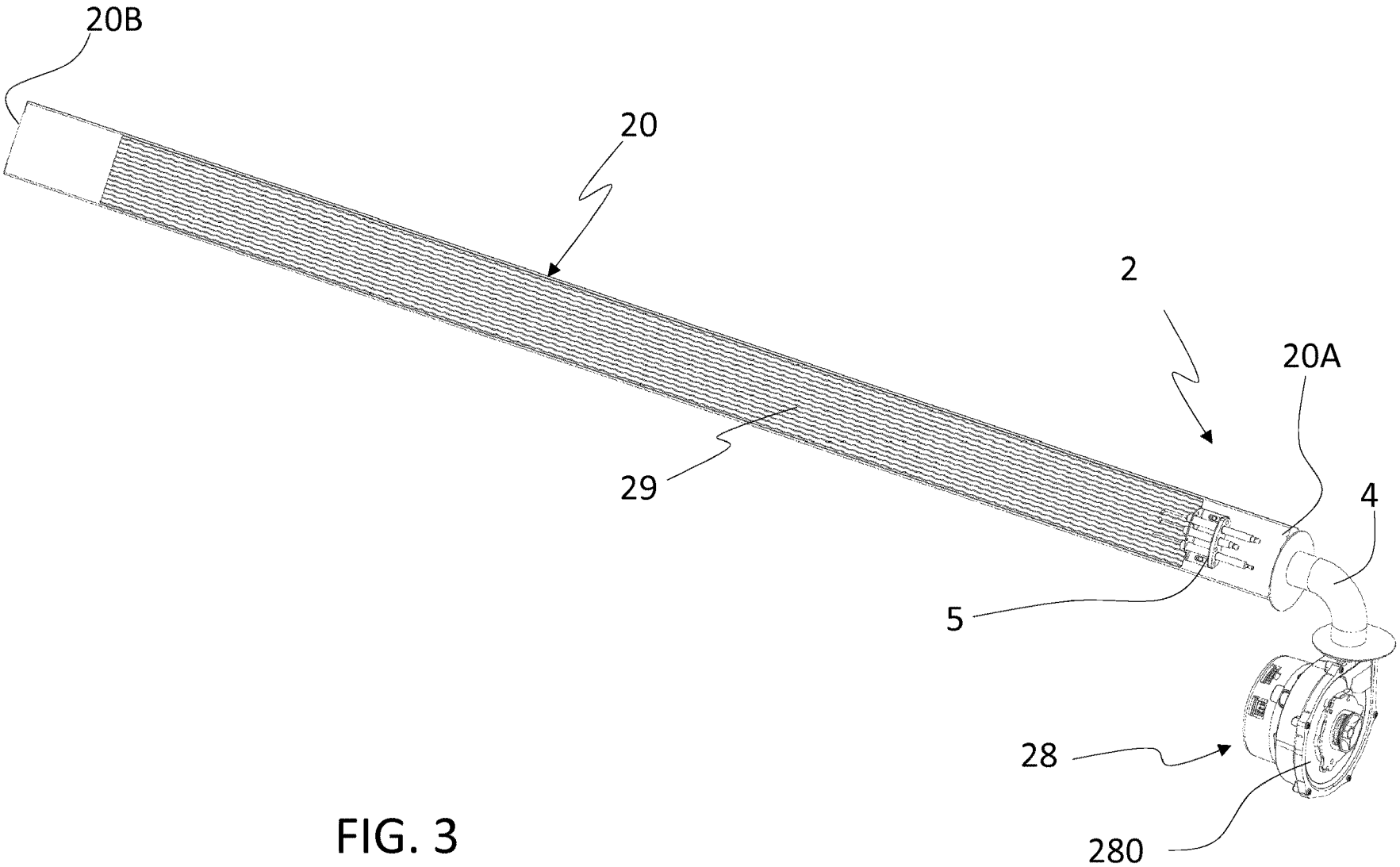
FIG. 3 is a perspective view of the burner assembly of FIG. 2, in which some components have been removed.
Figure 4:
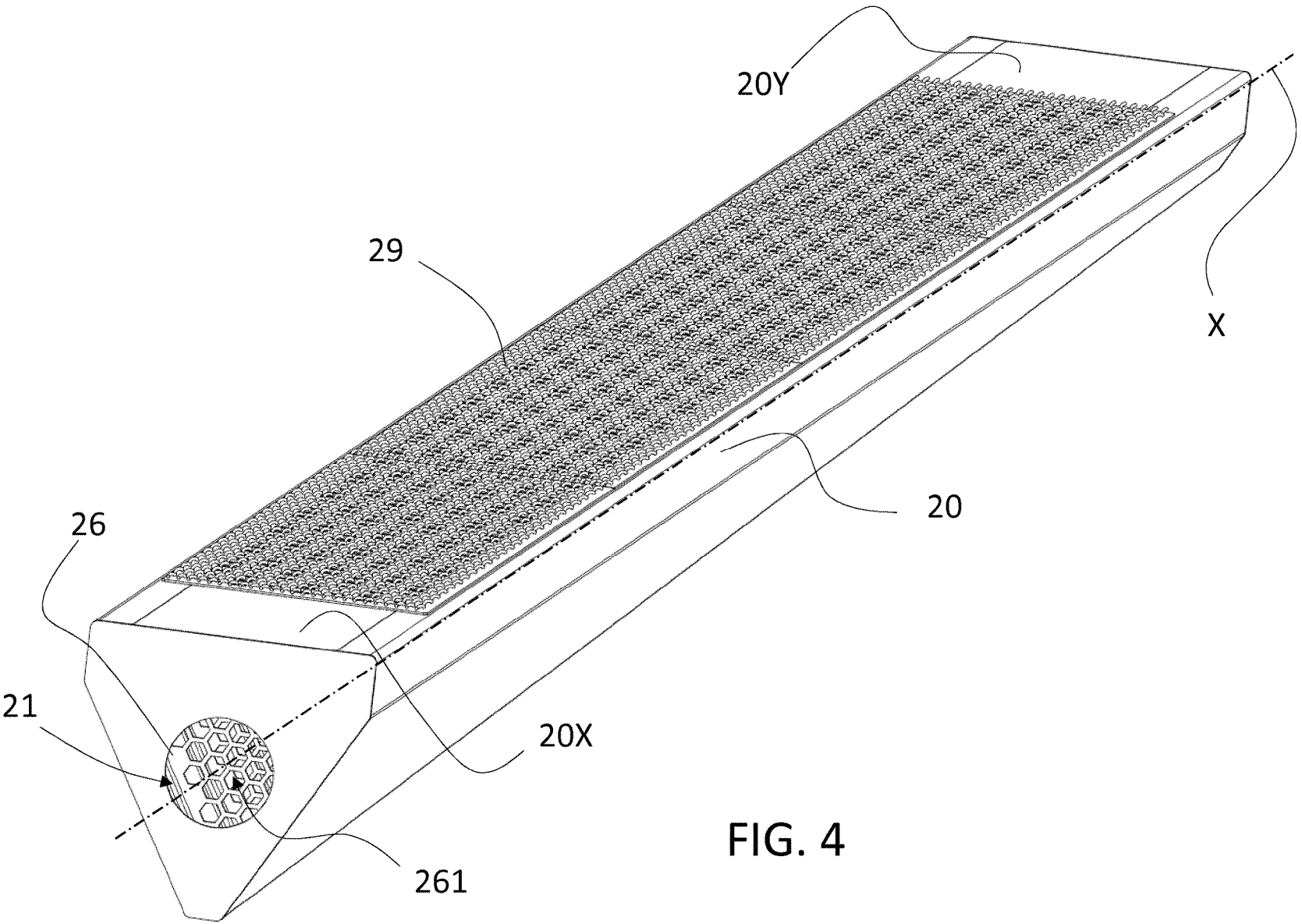
FIG. 4 is a partial perspective view of a main body of the burner assembly of FIG. 3.

The ironing apparatus according to the present invention comprises a rotating cylinder 1, shown in FIG. 2, and belt or endless belt members 3.

Preferably, belt members 3 travels on rollers, not shown in attached Figures, whose axes are preferably parallel to a rotation axis R of the cylinder 1.

Belt members 3 and rotating cylinder 1 are arranged such that they contact each other over a part of the circumference of the cylinder.

The linen, laundry or any other kind of item to be ironed (not illustrated) is introduced into an introduction zone 101 for the ironing apparatus 100, preferably located in proximity of the upper region of the rotating cylinder 1.

The item to be ironed is thus introduced between the rotating cylinder 1 and the belt members 3, and it is driven by the latter so as to be dried and ironed, particularly under a heating effect of the rotating cylinder 1.

To this end, the ironing machine according to the present invention further comprises a burner assembly 2, positioned at least partially within the rotating cylinder 1, so as to heat the latter, as will be better described in the following. The processed ironed item passes out of the apparatus 100 in a discharge zone 102 positioned in the lower region of the rotating cylinder 1.

With reference now to FIG. 2, according to a preferred embodiment, the burner assembly 2 comprises an air introduction device 28 (placed preferably outside the rotating cylinder 1), preferably comprising a blower 280, an air-gas mixing chamber 4 and a main body 20 (placed preferably within the rotating cylinder 1) toward which the mixture of air and gas is directed.

Preferably, the burner assembly 2 further comprises a filter element, not shown, located upstream said air introduction device 28. According to a further preferred embodiment, the filter element comprises a cyclone separator in order to reduce the presence of dust or lint in the air stream provided by the blower 280.

Figure 5A:
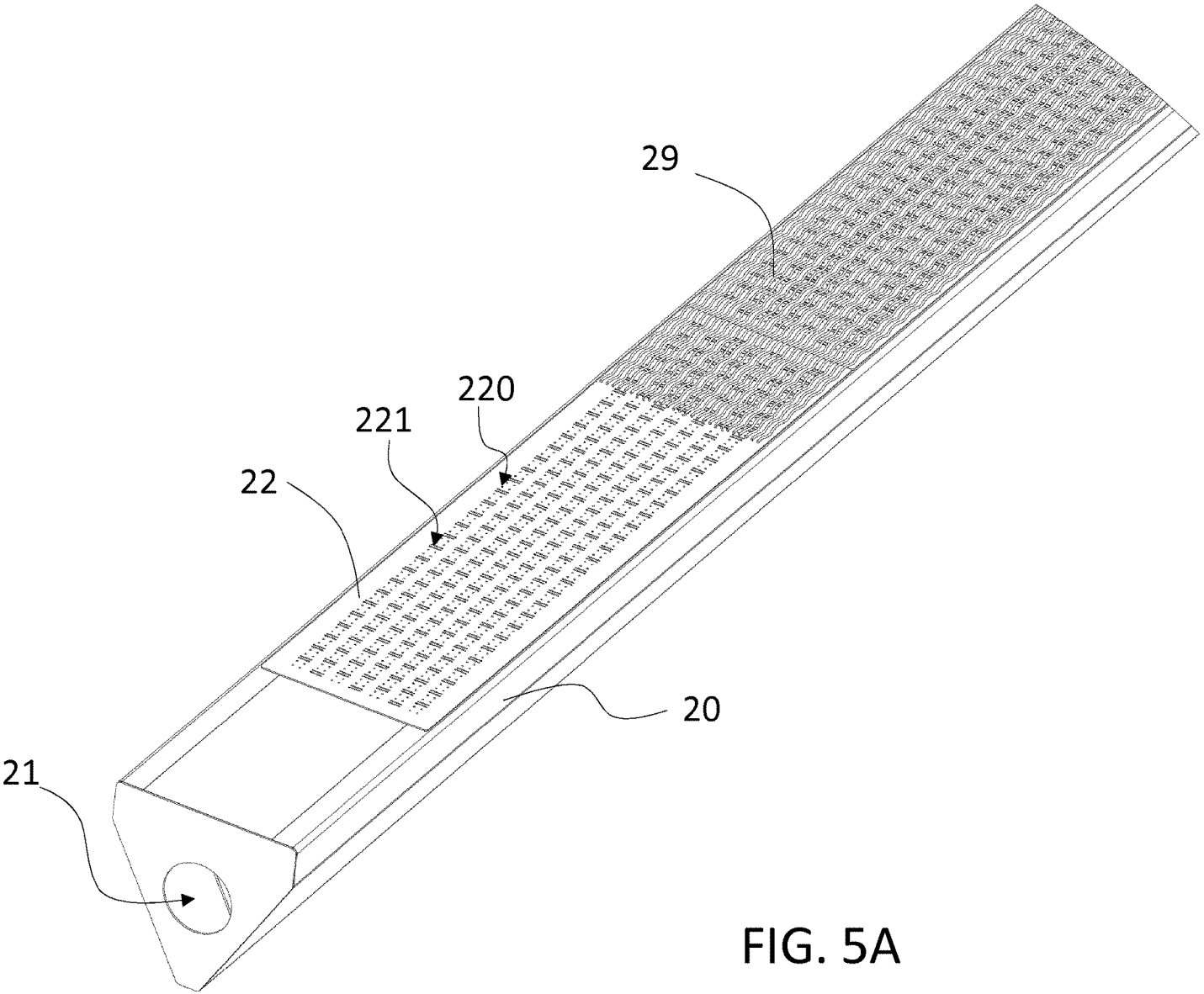
FIGS. 5A and 5B are two partial perspective views of the main body of FIG. 4.
Figure 5B:
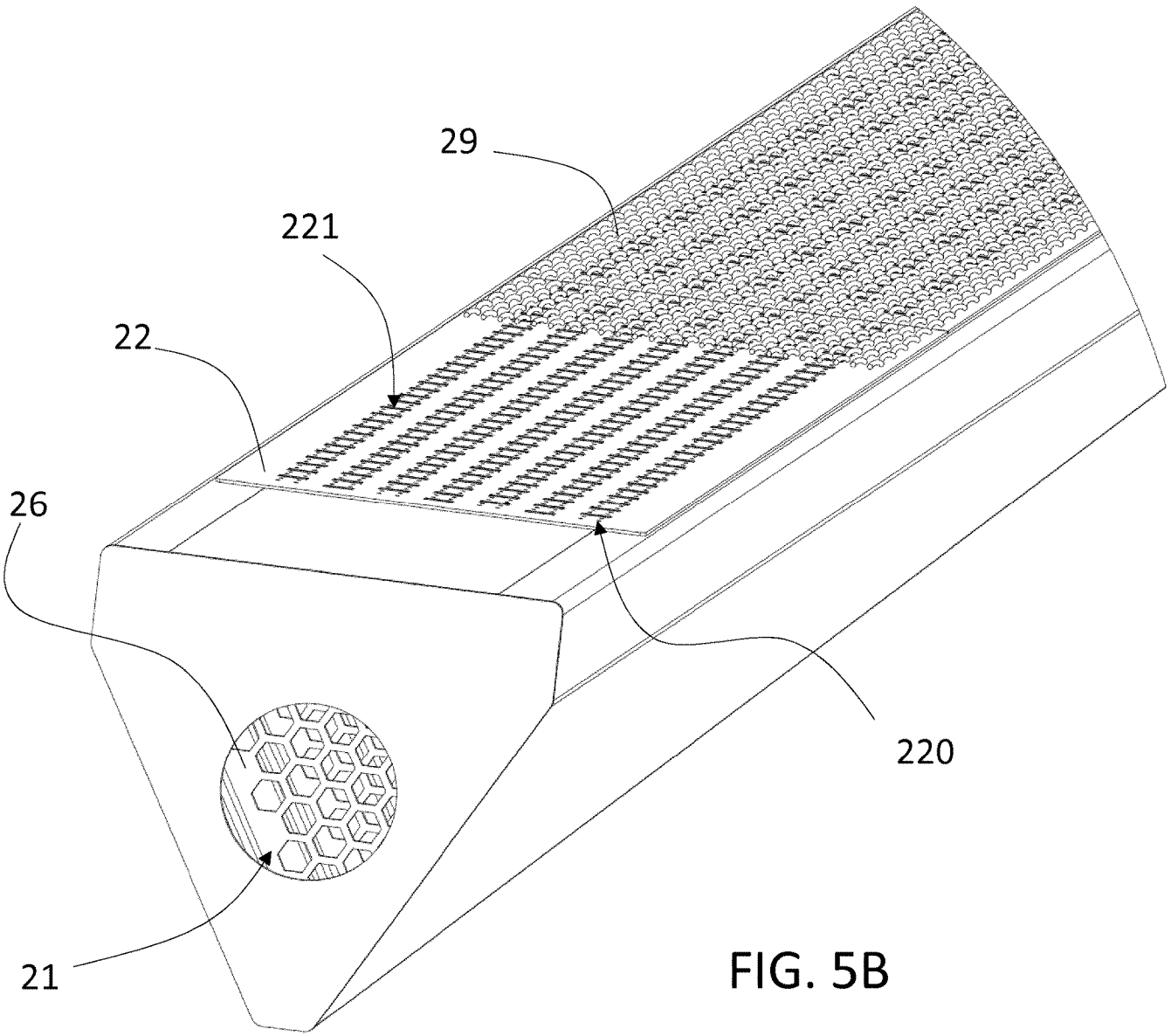
Figure 5C:
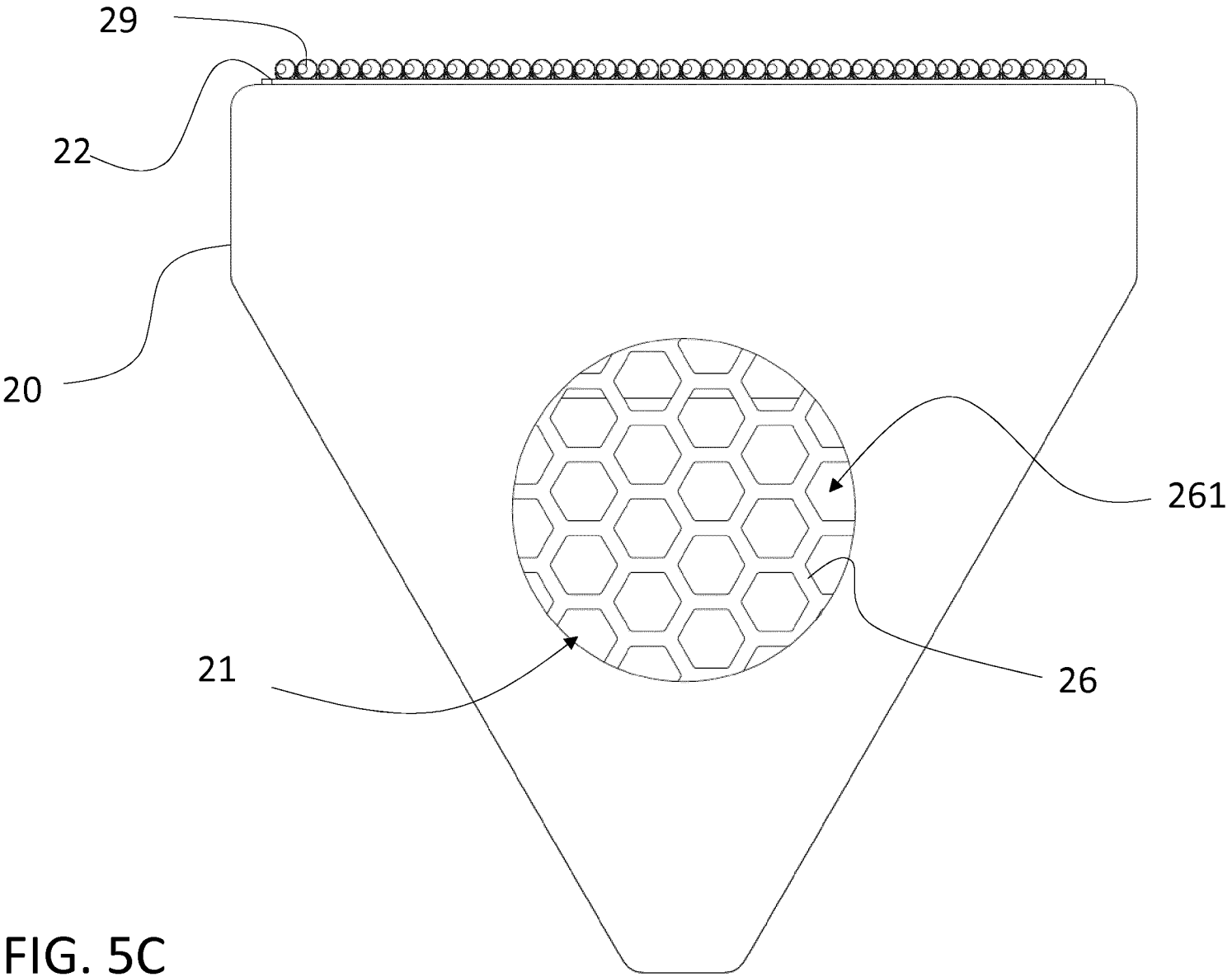
FIG. 5C is a frontal view of the main body of FIG. 4

The main body 20 further comprises an outlet surface 22, facing the rotating cylinder 1, better shown in FIG. 5A, in which a plurality of holes 220 are defined, through which the mixture of air and gas exits in order to be burned. According to an alternative embodiment, not shown in the Figures, the outlet surface 22 can also be at least partially curved.

According to a preferred embodiment, holes 220 are alternated with elongated slots 221; this particular configuration of the holes and slots has been proved very effective for guaranteeing a good structural resistance of the surface 22 to the stresses related to the thermal deformation. In addition, this configuration allows a very good distribution of the flames on the outlet surface 22.

Preferably, an ignition element 5 is provided, advantageously in the vicinity of a portion of the outlet surface 22, in order to ignite the mixture of gas and air traversing the holes 220 and slots 221.

According to a preferred embodiment, the main body 20 is positioned inside the rotating cylinder 1 and extends over most of the length thereof.

Preferably, the main body is placed in a lower region of the cylinder 1, i.e. in the vicinity of the linen discharge zone 102.

In order to allow the mixture of gas and air to flow through the whole extension of the main body 22, or at least to the part of the latter having the outlet surface 22, a passage 21, in which the mixture of air and gas flows, is defined in the main body 20.

According to a preferred embodiment, the passage 21 is connected to the air introduction device 28 and to the air-gas mixing chamber 4, from which it receives a flow rate of the mixture of air and gas. The mixture of gas and air is then directed to the outlet surface 22 where ignition of gas occurs as previously explained.

In the ironing apparatus according to the present invention, the passage 21 is therefore elongate-shaped and extends in a longitudinal direction X of the main body 20, inside the rotating cylinder 1. "X" is the longitudinal axis of the main body 20, which advantageously coincides with the longitudinal axis of the passage 21.

Figure 6A:
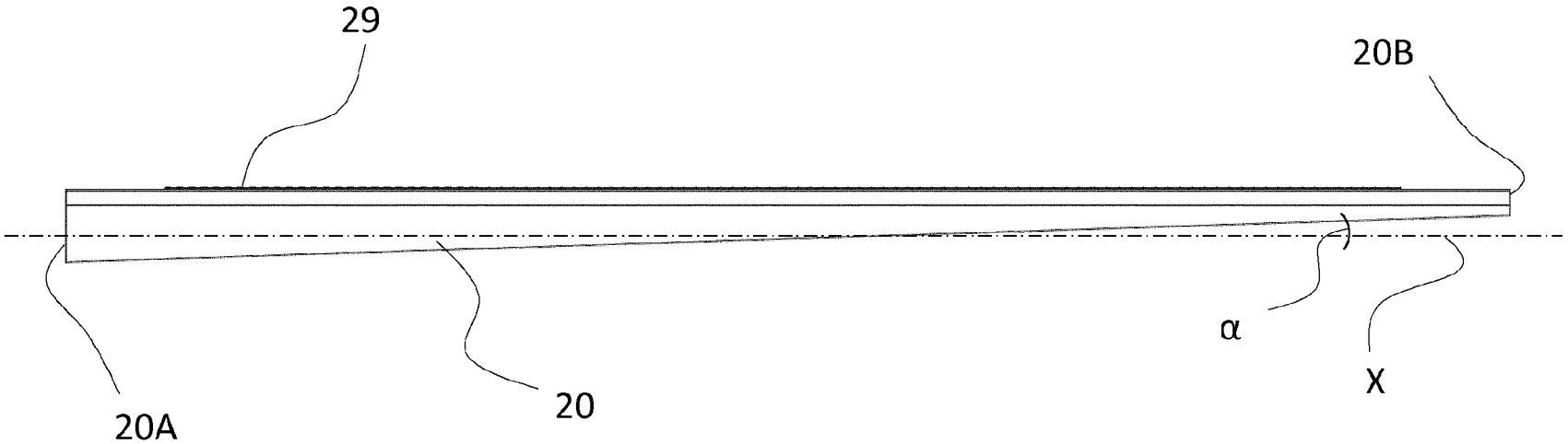
FIGS. 6A and 6B are a lateral view and a respective section view, respectively, of the main body of FIG. 4.

The flow of air and gas mixture within the main body 20 is schematically indicated in FIG. 6A with arrows 500.

In the embodiment illustrated in attached figures, outlet surface 22 advantageously extends in a central region of the main body 20, and the main body 20 advantageously comprises, at its extremities, end surfaces 20X, 20Y, preferably flush with the outlet surface 22, which are advantageously imperforated, so that they are not interested by the flames.

In a further advantageous embodiment, not illustrated, the outlet surface 22 extends substantially along the whole longitudinal extension of main body 20.

According to a preferred embodiment, the longitudinal direction X is substantially parallel to a rotation axis R of the rotating cylinder 1.

According to a preferred embodiment, the main body 20 is formed by folded metal sheets, forming a box-like structure shaped as a frustum of an irregular pyramid. It will be therefore appreciated that, in the present embodiment, the passage 21 is shaped according to such box-like structure.

Preferably, the main body 20 is fixed, preferably at one or both its ends 20A, 20B, to a structure supporting the rotating cylinder 1 and, accordingly, it also extends parallel to the rotation axis R of the rotating cylinder 1.

Figure 6B:
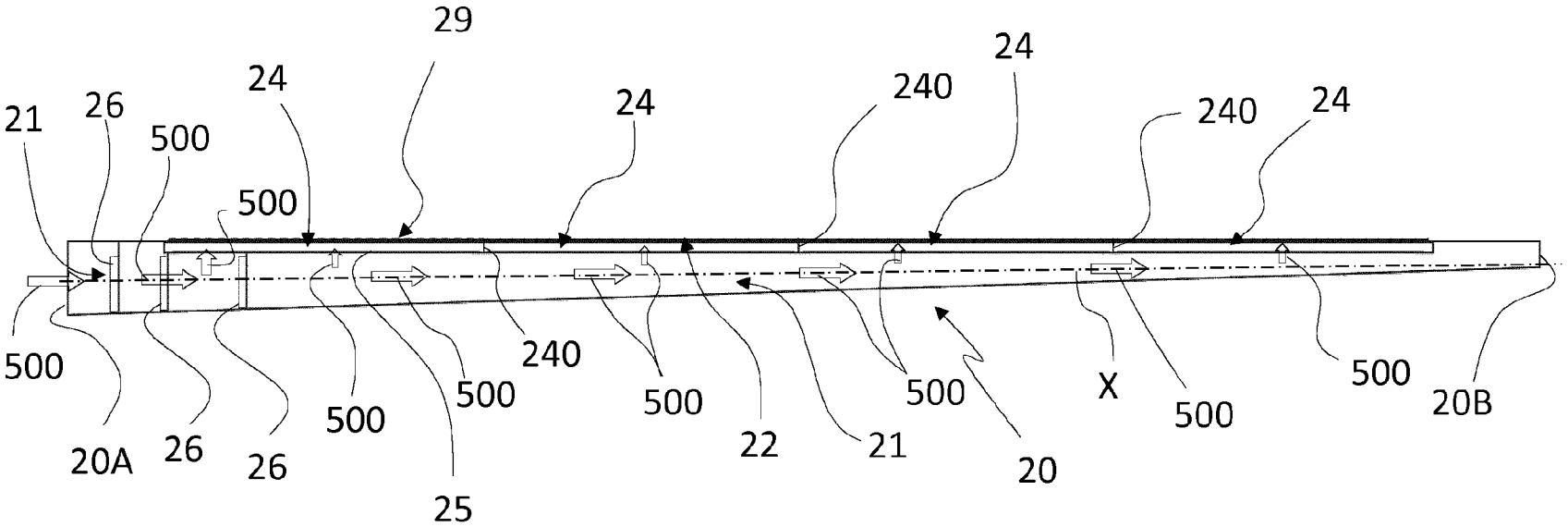

As it can be appreciated in FIGS. 2 and 6B, in the ironing apparatus according to the present invention the passage 21 has from the end 20A in which the air and gas mixture enters the main body 20 to the opposite end 20B, a decreasing cross section along said longitudinal direction X.

It will be also apparent that, in the present embodiment, the main body 20 also exhibits a similar tapering development, with a cross section gradually decreasing from a first end 20A thereof, i.e. the end connected to the air introduction device 28, towards the opposite end 20B. Preferably the bottom surface of the main body 20 is flat and more preferably it is inclines of an angle $\alpha$ with respect to the longitudinal direction X; preferably $\alpha$ is comprised between [5-30]°, more preferably it is 12°.

According to a preferred embodiment, cross section of the passage 21 next to the opposite end 20B of the main body 20 has a size comprises between 40% and 80% of the size of the cross section next to the first end 20A, more preferably comprised between 50% and 70%, even more preferably 65% of the size of the cross section next to the first end 20A Therefore, according to these aspects of the invention, the flow-rate of the mixture of air and gas varies along the longitudinal direction X of the passage 21 and of the main body 20.

Preferably, the density and the dimension of holes 220 of the outlet surface 22 is constant along said longitudinal direction X.

Figure 7A:
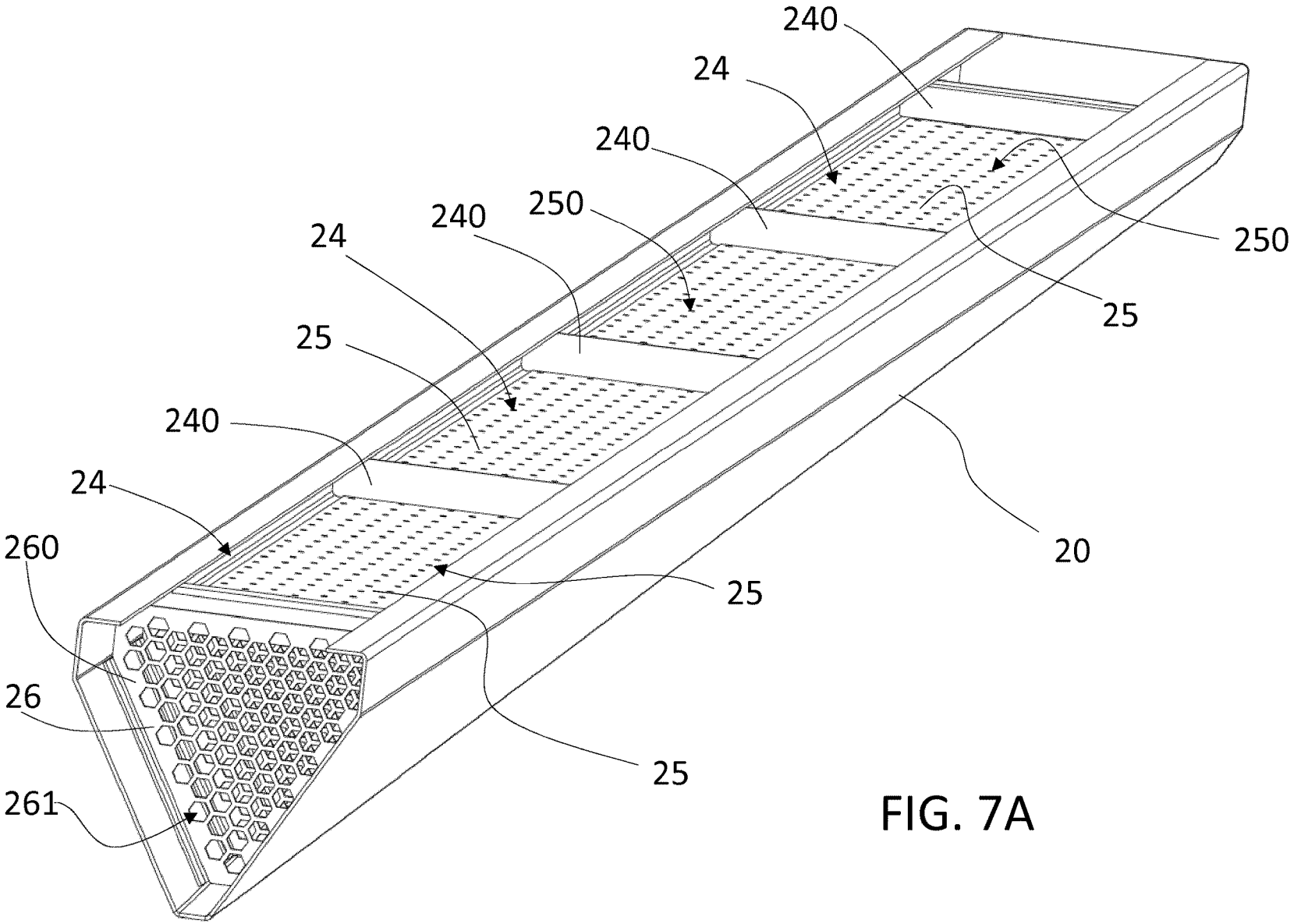
FIGS. 7A and 7B are a perspective view and a respective detail of the main body of FIG. 4 in which some components have been removed for showing other internal features.

With reference now to FIGS. 6B and 7A,B, according to a preferred embodiment, the main body 20 comprises a premixing zone 24 intermediate between the passage 21 and the outlet surface 22.

Preferably, the premixing zone 24 is separated by the passage 21 by means of a perforated surface 25.

Preferably, holes 250 are defined in the perforated surface 25. According to a preferred embodiment, holes 250 of the perforated surface 25 are bigger than holes 220 defined in the outlet surface 22.

Always preferably, the perforated surface 25 is parallel to the outlet surface 22.

Furthermore, according to a preferred embodiment, the premixing zone 24 comprises dividing elements 240, preferably formed by solid walls avoiding the passage of the mixture of air and gas.

Therefore, according to this advantageous aspect, the premixing zone 24 is divided into a plurality of portions, each connected to the passage 21 from which they receive the mixture of air and gas.

It will be also appreciated that in the present embodiment, the premixing zone 24 is defined in the same box-like structure forming the main body 20 and also defining the passage 21.

Always with reference to FIG. 6B, the burner assembly 2 preferably further comprises at least one turbulator 26 provided upstream or at the beginning of said passage 21 and preferably located in the main body 20.

According to the present embodiment, the main body advantageously comprises one turbulator 26 located at the inlet of the passage 21, and preferably other two turbulators 26 located upstream and downstream the latter, respectively.

Figure 7B:
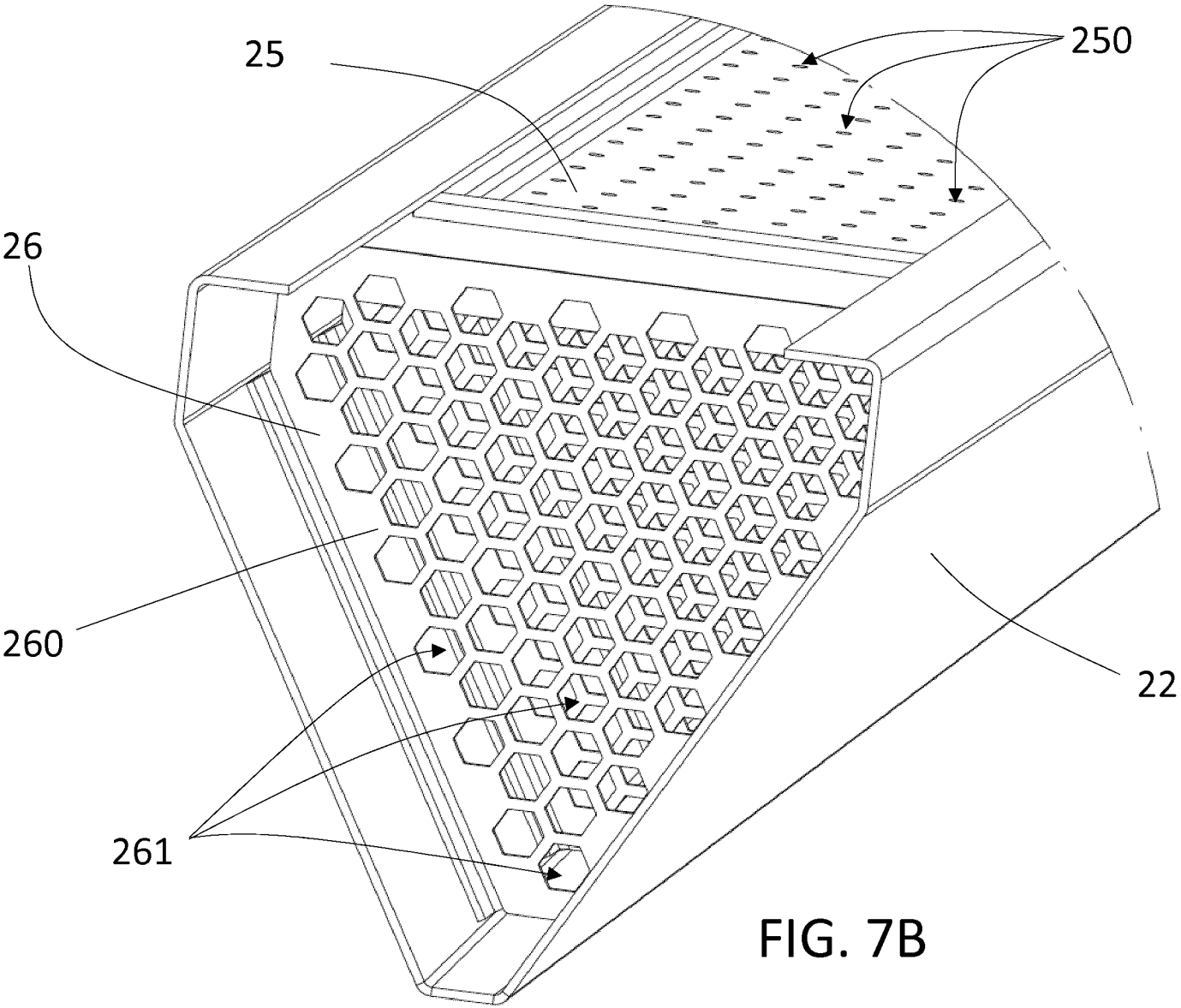

With reference now to FIGS. 7A and 7B, the turbulator/s 26 preferably comprise/s a perforated surface 260 having holes 261, preferably hexagonal shaped.

With reference now to FIGS. 3, 4, 5A, 5B and 5C, according to a preferred embodiment, the burner assembly 2 further comprises a metal mesh 29, covering the outlet surface 22.

The flames produced in the outlet surface 22 and their fumes heat up the metal mesh 29, which becomes incandescent and starts irradiating heat towards the rotating cylinder 1, which is therefore heated up.

According to a further advantageous aspect, the present invention also relates to a control method for the previously described ironing apparatus or, more in general, for an ironing apparatus comprising a rotating cylinder 1 and a burner assembly 2.

In the control method according to the present invention, the flow-rate of the mixture of air and gas flowing in a passage defined in the burner assembly is adjusted according to both a temperature level measured on an outer diameter of the rotating cylinder and a moisture level of an item subjected to ironing and to the type of fabric of which the item subjected to ironing is made.

Figure 1A:
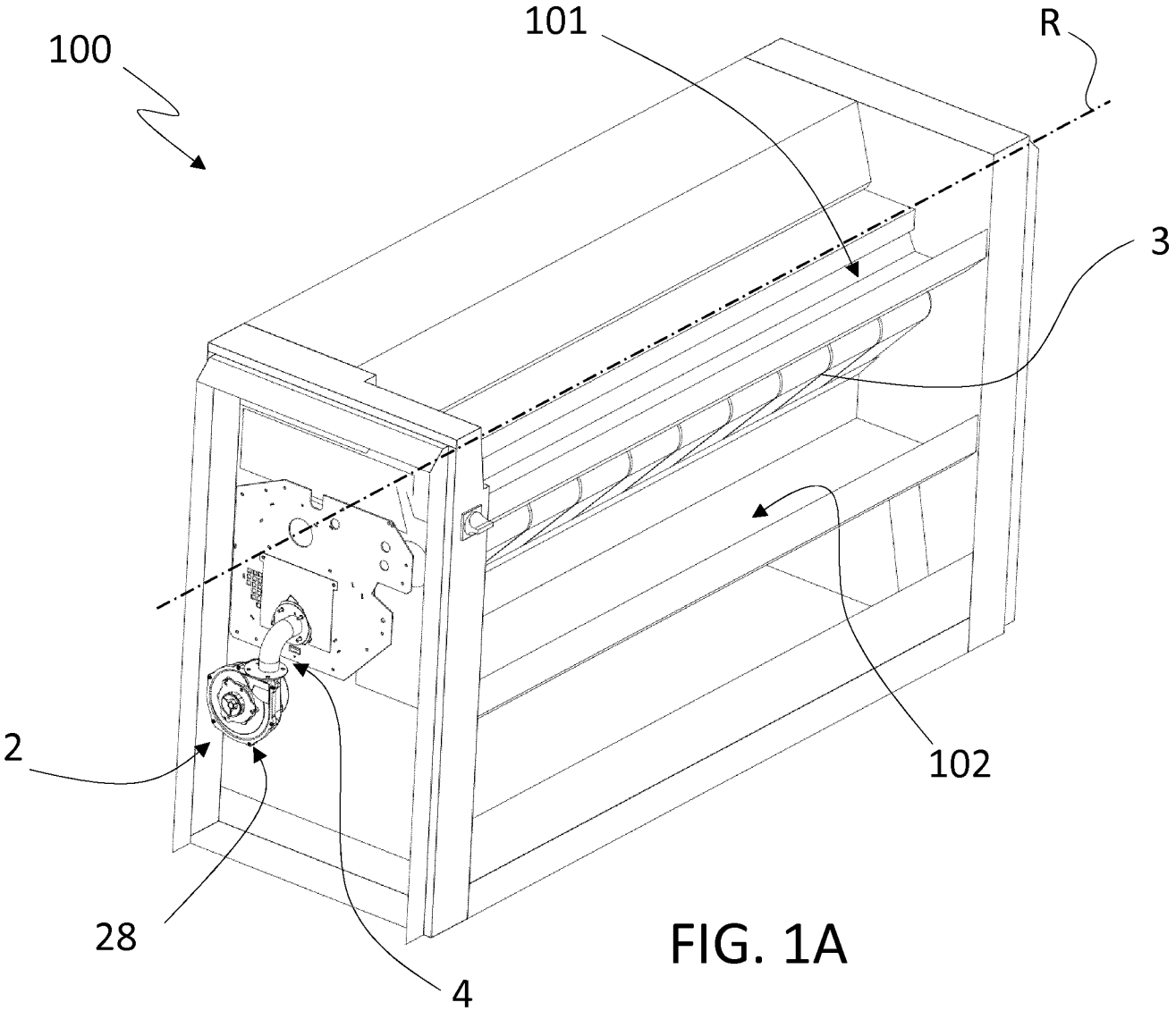
FIGS. 1A and 1B are perspective views according to different angles of an ironing apparatus according to the present invention.
Figure 1B:
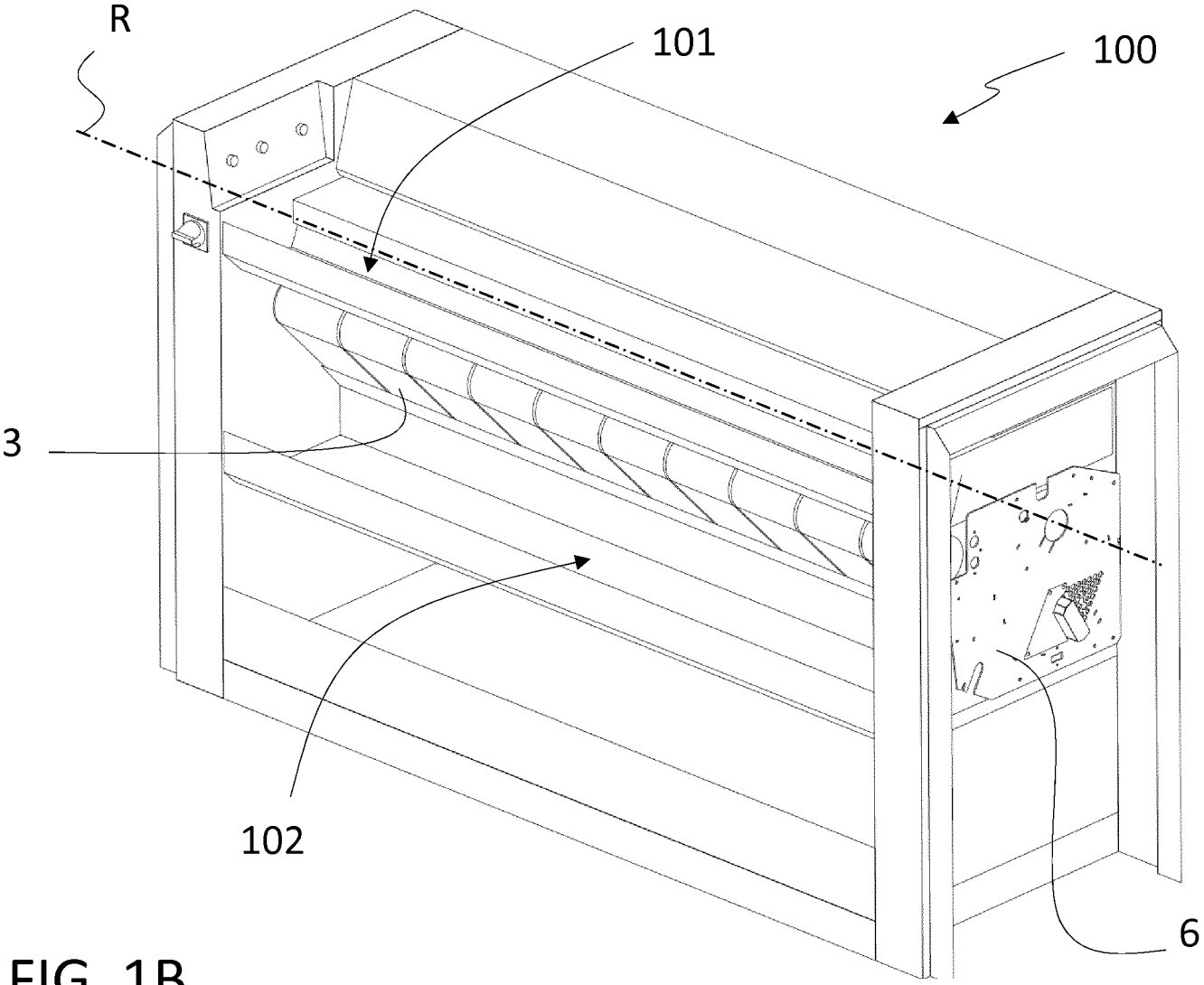

To this end, the ironing apparatus further comprises a control unit 6, schematically shown in FIG. 1B, by which a type of fabric of the item is selected, and receiving data relating to temperature and moist.

To this end, the ironing apparatus 100 may also comprise a control panel, not shown in the drawings, by which the type of fabric is selected and transmitted to the control unit 6.

Preferably, the flow-rate of the mixture of air and gas is regulated by adjusting the speed of the blower 280 that is also connected and controlled by the control unit 6.

Furthermore, according to a preferred embodiment, also the rotation speed of the rotating cylinder 1 can be adjusted according to temperature and moisture level measured and according to the type of fabric determined.

It will be therefore appreciated that the control method according to present invention could be applied both to ironing apparatus comprising a passage for the mixture of air and gas having a decreasing cross section, as in the embodiment previously described, and to ironing apparatus in which the passage has a constant cross section.

As a matter of fact, in both cases, the control method allows to obtain a reduction of the duty cycle of the burner assembly and to increase the efficiency of fuel consumption.

The invention claimed is:

1. An ironing apparatus (100) comprising:

a rotating cylinder (1);

a burner assembly (2) comprising a main body (20) in which a passage (21) for a mixture of air and gas is defined, said main body (20) comprising an outlet surface (22) in which a plurality of holes (220) are defined, through which the mixture of air and gas exits from said passage (21), wherein said passage (21) is elongate-shaped and extends in a longitudinal direction (X) inside said rotating cylinder (1);

characterized in that said passage (21) has a decreasing cross section along said longitudinal direction (X).

2. The ironing apparatus (100) according to claim 1, wherein said longitudinal direction (X) is substantially parallel to a rotation axis of the rotating cylinder (1).

3. The ironing apparatus (100) according to claim 1, wherein said main body (20) comprises a premixing zone (24) intermediate between said passage (21) and said outlet surface (22), said premixing zone (24) being separated by said passage (21) by a perforated surface (25).

4. The ironing apparatus (100) according to claim 3, wherein said perforated surface (25) is parallel to said outlet surface (22).

5. The ironing apparatus (100) according to claim 3, wherein holes (250) defined in said perforated surface (25) are bigger than said holes (220) defined in said outlet surface (22).

6. The ironing apparatus (100) according to claim 1, wherein said burner assembly comprises an air introduction device (28), said cross section of said passage (21) gradually decreasing from a first end (20A) of the main body (20) connected to said air introduction device (28) towards the opposite end (20B) thereof.

7. The ironing apparatus (100) according to claim 6, wherein said burner assembly comprises a filter element comprising a cyclone separator, said cyclone separator being located upstream said air introduction device (28).

8. The ironing apparatus (100) according to claim 1, wherein the density and the dimension of holes (220) of said outlet surface (22) is constant along said longitudinal direction (X).

9. The ironing apparatus (100) according to claim 1, wherein said burner assembly (2) comprises at least one turbulator (26) provided upstream or at the beginning of said passage (21).

10. The ironing apparatus (100) according to claim 9, wherein said at least one turbulator (26) comprises a perforated surface (260) having holes (261).

11. The ironing apparatus (100) according to claim 1, wherein said outlet surface (22) is at least partially curved.

12. The ironing apparatus (100) according to claim 1, wherein said burner assembly (2) further comprises a metal mesh (29) covering said outlet surface (22).

13. A control method for an ironing apparatus (100) comprising a rotating cylinder (1), a burner assembly (2) comprising a main body (20) in which a passage (21) for a mixture of air and gas is defined, said main body (20) comprising an outlet surface (22) in which a plurality of holes (220) are defined, through which the mixture of air and gas exits from said passage (21), wherein said passage (21) is elongate-shaped and extends in a longitudinal direction (X) inside said rotating cylinder (1), the method comprising:

measuring temperature on an outer diameter of the rotating cylinder;

measuring a moisture level of an item subjected to ironing;

determining the type of fabric of the item subjected to ironing;

adjusting the flow-rate of the mixture of air and gas according to temperature and moisture level measured and according to the type of fabric determined.

14. The control method according to claim 13, further comprising adjusting the rotation speed of the rotating cylinder (1) according to temperature and moisture level measured and according to the type of fabric determined.

15. The control method according to claim 13, wherein the burner assembly (2) comprises an air introduction device (28) including a blower (280), and wherein adjusting the flow-rate of the mixture of air and gas comprises adjusting the speed of said blower (280).

16. The ironing apparatus (100) according to claim 9, wherein said at least one turbulator (26) comprises a perforated surface (260) having hexagonal-shaped holes (261).

* * * * *